US005707195A

United States Patent [19]

Scholz

[11] Patent Number: 5,707,195

[45] Date of Patent: Jan. 13, 1998

[54] APPARATUS FOR MANIPULATING WIRE BINDERS

[75] Inventor: Jürgen Scholz, Oberboihingen, Germany

[73] Assignee: Womako Maschinenkonstruktionen GmbH, Nurtingen, Germany

[21] Appl. No.: 725,145

[22] Filed: Oct. 2, 1996

[30] Foreign Application Priority Data

Oct. 21, 1995 [DE] Germany ..... 195 39 213.2

[51] Int. Cl.[6] ..... B42B 5/10

[52] U.S. Cl. ..... 412/39; 412/38

[58] Field of Search ..... 412/39, 38, 33, 412/11, 12, 9

[56] References Cited

U.S. PATENT DOCUMENTS

| | | | |
|---|---|---|---|
| 3,334,918 | 8/1967 | Pigna et al. | 412/39 |
| 3,451,081 | 6/1969 | Liouville | 412/39 |
| 4,031,585 | 6/1977 | Adams | 412/39 |
| 4,047,544 | 9/1977 | Seaborn | 140/105 |

FOREIGN PATENT DOCUMENTS

| | | |
|---|---|---|
| 24 03 154 | 8/1980 | Germany . |
| 31 41 686 | 2/1995 | Germany . |
| 295 02 604 | 5/1995 | Germany . |
| 987117 | 3/1965 | United Kingdom . |
| 1209940 | 11/1967 | United Kingdom . |
| 2 257 070 | 1/1993 | United Kingdom . |
| 2257070 | 1/1993 | United Kingdom . |

*Primary Examiner*—Andrea L. Pitts
*Assistant Examiner*—Gregory Andoli
*Attorney, Agent, or Firm*—Darby & Darby

[57] ABSTRACT

Apparatus for transferring successive wire comb binders from a first station, at which the binders arrive by moving lengthwise, to a second station, to which successive binders are advanced by moving sideways, has a pusher which advances successive binders along a path wherein the binders slide relative to one or more guide rails. The pusher cooperates with a braking device to change the orientation of successive binders during advancement toward the second station. The braking device can employ one or more magnets if the binders contain a magnetizable material, and/or one or more friction generating units which slow down or arrest the adjacent portions of successive binders. A mobile abutment at the second station determines the extent to which the orientation of successive binders can be changed and positions successive reoriented binders for removal of successive binders from the second station by a reciprocable plunger or another suitable conveyor.

21 Claims, 2 Drawing Sheets

APPARATUS FOR MANIPULATING WIRE BINDERS

BACKGROUND OF THE INVENTION

The invention relates to improvements in apparatus for manipulating so-called wire comb binders which are used to hold together stacks of sheets of the type having a row of perforations along one of their edges. More particularly, the invention relates to improvements in apparatus for transferring successive wire comb binders from a first station (for example, a station at which a continuous open binder having a substantially C-shaped cross-sectional outline is broken up or subdivided into a series of successive binders having a fixed length) to a second station at which the binders of the series are introduced into the perforations of successive stacks or piles of sheets or from which successive binders of the series are conveyed to the actual binder inserting station or stations.

It is known to advance successive binders of a short or long series of binders from a first station to a second station by advancing successive binders of the series sideways, namely transversely of the longitudinal axes or extensions of the binders. Such binders are obtained by converting a continuous blank of wire into a binder having a substantially C-shaped cross-sectional outline and including a row of tips or prongs along one of its longitudinal edges, a row of substantially flat webs along its other longitudinal edge, and a row of inwardly bent (substantially V-shaped spines substantially midway between the two edges. The tips are introduced into the perforations of a stack of sheets and the binder is thereupon deformed at the spines to furnish a series of coherent ring-shaped sections which enable the thus closed binder to act as a pivot or fulcrum defining an elongated axis for pivoting of the sheets relative to each other between open and closed positions.

A stack of marginally perforated sheets can be held together by a single binder which extends at least substantially the full length of the perforated edges of the sheets, or by two or more aligned binders having tips or prongs extending through selected groups of perforations of stacked sheets.

In accordance with a known proposal, each freshly formed binder of finite length is moved into the range of a holder which includes one or more magnets to attract a binder while the holder is being pivoted to change the orientation of the attracted binder before the latter reaches an inserting or binding station where its tips or prongs are caused to enter the perforations of a pile or stack of superimposed sheets. The next step involves suitable deformation of the inserted binder to convert it into a series of coherent annular sections. Reference may be had, for example, to published German patent application No. 24 03 154 C3. Another published German patent application (No. 31 41 686 C2) discloses the manipulation of the aforediscussed sets of relatively short binders (the so-called skip binders) which are used in sets of two or more to extend only through certain selected groups of perforations in the marginal portions of sheets forming part of a pile or stack about to be converted into a steno pad or another stationery product.

In accordance with still another prior proposal, groups of open binders (i.e., binders still having a substantially C-shaped cross-sectional outline) are stored on supporting strips or bands to jointly constitute a mat of arrayed binders. Such mats can be readily stored and/or transported to the inserting station or stations. Reference may be had, for example, to British patent No. 987 117 and to published UK patent application No. 2 257 070 A.

A drawback of presently known apparatus which are used to manipulate C-shaped wire binders is that they are too bulky, too complex and/or too slow. For example, the apparatus which is disclosed in the aforementioned published German patent application No. 24 03 154 C3 employs a pivotable arm which carries the holder and its magnet or magnets to move the holder along an arcuate path of approximately 90° and to thus change the orientation of a freshly formed binder of finite length which is to be transferred from a first (subdividing) station to a second (e.g., inserting) station. The space requirements of this apparatus are such that the apparatus contributes excessively to the bulk and weight of the machine or production line in which successive stacks of marginally perforated paper sheets are to be converted into pads, booklets, catalogs, calendars and/or other stationery products.

OBJECTS OF THE INVENTION

An object of the invention is to provide a simple, compact and inexpensive apparatus for manipulating open (C-shaped) wire comb binders for stacks of marginally perforated sheets of paper or the like.

Another object of the invention is to provide a novel and improved apparatus for changing the orientation of open wire comb binders at a frequency which is required for the transport of successive binders to an inserting station.

A further object of the invention is to provide a novel and improved apparatus for the manipulation of binders which contain a magnetizable material.

An additional object of the invention is to provide a novel and improved apparatus for the manipulation of binders which do not or need not contain a magnetizable material.

Still another object of the invention is to provide the above outlined apparatus with novel and improved means for controlling the positions of open binders during advancement between at least two successive stations.

A further object of the invention is to provide a novel and improved method of manipulating, particularly of changing the orientation of, open wire binders during transport to the inserting station.

Another object of the invention is to provide an apparatus which is constructed and assembled in such a way that it can change the orientation of a short or long series of open binders without requiring any additional space for such manipulation of the binders.

An additional object of the invention is to provide an apparatus which is subject to little wear so that it can be operated without interruptions in mass-producing machines or production lines for long periods of time.

SUMMARY OF THE INVENTION

The invention is embodied in an apparatus for transferring successive wire comb binders for piles, stacks or analogous accumulations of perforated sheets from a first station (to which the binders are supplied and/or at which the binders are maintained in a first orientation) to a second station (e.g., a station from which the binders are conveyed toward actual engagement with accumulations of sheets). The improved apparatus comprises guide means which defines a path extending from the first station to the second station, means for advancing successive binders along the path from the first station to the second station, and means for changing the orientation of binders during advancement along the path.

The guide means can be designed to induce a sliding movement of successive binders from the first station toward the second station, and the advancing means can comprise means for pushing successive binders along the path. To this end, the guide means can comprise at least one guide rail or track extending along at least a portion of the path from the first station toward the second station.

As a rule, or at least in many instances, the binders are or can be elongated, and the advancing means preferably comprises means for moving such elongated binders sideways, namely at least substantially transversely of the longitudinal axes of the elongated binders. The means for changing the orientation of successive binders preferably includes means for turning the binders about the respective longitudinal axes. It is presently preferred to design the improved apparatus in such a way that the turning means cooperates with the moving means of the binder advancing means to exert a tilting torque or moment upon a binder which is being advanced along the path from the first station toward the second station. The means for turning successive binders can be positioned adjacent a portion of the path and can include means for braking a first portion of a binder advancing along the path while the moving means of the advancing means advances a second portion of the binder being braked by the braking means so that the second portion of the binder moves relative to the first portion about the respective longitudinal axis.

If the binders consist of or contain a magnetizable material, the braking means can comprise at least one magnet which attracts the first portion of a binder advancing along the path in a direction from the first station toward the second station. Such at least one magnet is or can be disposed at a level beneath the respective portion of the path.

Regardless of whether the binders consist of or contain a magnetizable material, the braking means can include means for frictionally engaging the first portion of a binder which is being advanced along the path. Such means for frictionally engaging can form part of the guide means and can be utilized with particular advantage if the binders do not contain a magnetizable material. The means for frictionally engaging can actually define a portion of the path for the advancement of successive binders from the first station to the second station.

The apparatus can further comprise at least one mobile abutment for successive binders which reach or approach the second station, and more specifically for successive binders which are being advanced toward the second station. Such apparatus preferably further comprises means for moving the at least one abutment along a portion of the path toward and away from the first station. The arrangement is preferably such that the abutment is positioned to limit the extent of changes of orientation of binders being advanced along the path. To this end, the means for moving the at least one abutment preferably comprises means for moving the at least one abutment between a first position nearer to the first station in which the at least one abutment terminates the change of orientation of the binder being advanced along the path, and a second position more distant from the first station in which the at least one abutment terminates the advancement of the binder along the path. Such apparatus preferably further comprises means for moving the at least one abutment at least substantially in synchronism with the advancing means for the binders, at least during movement of the at least one abutment from its first position toward its second position. Still further, such apparatus can comprise means for removing reoriented binders from the second station in the second position of the at least one abutment. Such removing means can comprise a conveyor (e.g., a reciprocable pusher) which is movable substantially transversely of the path for advancement of successive binders from the first station to the second station.

The novel features which are considered as characteristic of the invention are set forth in particular in the appended claims. The improved apparatus itself, however, both as to its construction and its mode of operation, together with additional novel features and advantages thereof, will be best understood upon perusal of the following detailed description of certain presently preferred specific embodiments with reference to the accompanying drawings.

DESCRIPTION OF PREFERRED EMBODIMENTS

Figure 1:
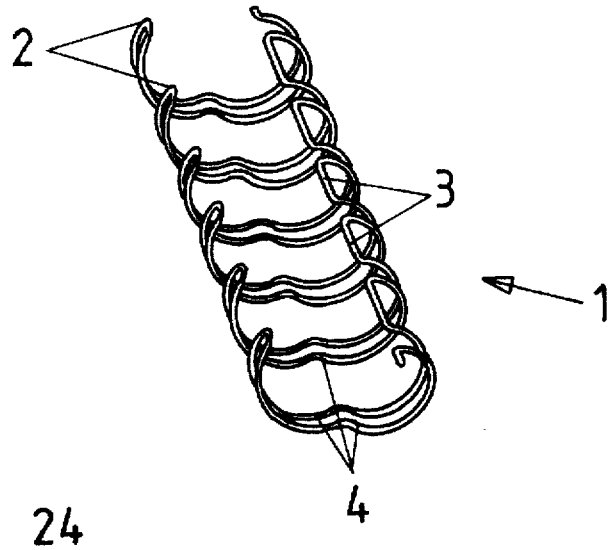
FIG. 1 is a perspective view of an open wire comb binder.

FIG. 1 shows a portion of an elongated wire comb binder 1 (hereinafter called binder or wire binder) which is still open, i.e., it has a substantially C-shaped cross-sectional outline with a row of equidistant tips or prongs 2 along one of its longitudinal edges, a row of equidistant straight or substantially straight webs 3 along the other longitudinal edge, and a centrally located row of substantially V-shaped spines 4 between the two longitudinal edges. When the binder 1 is to be put to use, the prongs 2 are introduced into the marginal perforations of a stack of superimposed sheets of paper or the like and the binder is thereupon deformed, at least in the region of the spines 4, so that it forms a series of substantially annular sections which enable the sheets of the thus obtained steno pad, calendar, catalog or another stationery product to be pivoted relative to each other about a central longitudinal axis of the deformed or finished binder. The axis is parallel to the rows of prongs 2 and webs 3.

The manner in which the prongs 2 of a binder 1 can be introduced into the perforations of a stack or pile of sheets or panels, e.g., by means of suitable tongs, is well known in the relevant art and forms no part of the present invention.

Figure 2:
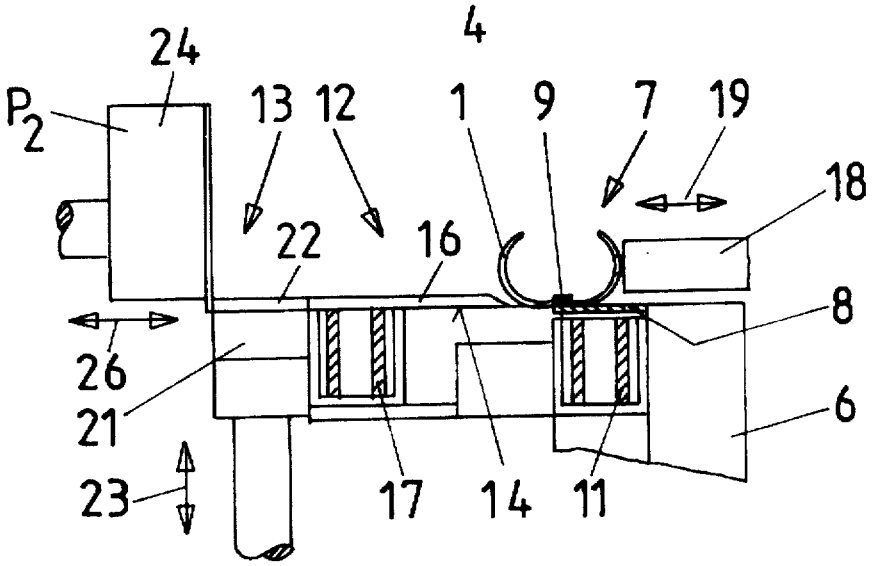
FIG. 2 is a fragmentary partly elevational and partly vertical sectional view of an apparatus which embodies one form of the invention, a binder being shown at the first stationed the abutment being maintained in its second position adjacent the second station.

FIG. 2 shows a portion of an apparatus which embodies one form of the instant invention and serves to transfer successive wire binders 1 from a first station 7 along a straight at least substantially horizontal path 14 to a second station 13. The apparatus comprises a housing or frame 6 which defines the stations 7, 13 and is associated with a conveyor 8 (e.g., a belt conveyor) serving to deliver a series of successive discrete open wire binders 1 to the station 7, e.g., in a direction at right angles to the plane of FIG. 2. Alternatively, the station 7 can receive a continuous open wire binder, and the apparatus of FIG. 2 then comprises suitable means (not specifically shown) for severing the continuous binder at desired intervals to form a file or row of elongated binders 1 each having a predetermined length (as measured in the longitudinal direction of the row of prongs 2, webs 3 or spines 4).

The exposed upper side of the conveyor 8 is preferably provided with claws, pins, studs or other suitable protuberances 9 which ensure predictable advancement of a continuous binder or of successive discrete binders 1 to the first station 7 as well as an optimum positioning of successive binders 1 at the station 7 for sidewise transport along the path 14 toward the second station 13. If the binders 1 contain or consist of a magnetizable material, the apparatus preferably further comprises one or more magnets 11 which are installed beneath the station 7 and hold the binder 1 at this station against vibratory and/or other undesirable stray movements.

The path 14 between the stations 7 and 13 is defined by suitable guide means 12 which, in the illustrated embodiment, comprises one or more guide rails 16 enabling successive binders 1 to slide sideways from the station 7 toward the station 13. The means for changing the orientation of successive binders 1 on their way from the station 7 toward the station 13 comprises one or more magnets 17 serving to brake the adjacent (first) portions of arriving binders which are advanced along the path 14 by a pusher 18 reciprocable in directions indicated by a double-headed arrow 19. Depending on the selected length of the binders 1 and on the dimensions of the illustrated magnet 17, the means for changing the orientation of successive binders 1 can include two or more magnets 17 which are disposed one behind the other as seen in FIGS. 2, 3, 4 or 5. The magnetic field which is established by the illustrated magnet 17 extends across a portion of the path 14 close to but still spaced apart from the second station 13 for reoriented binders 1. In other words, at least that portion of the guide means 12 which is located at a level immediately above the illustrated magnet 17 is permeable to the magnetic lines of force. The magnet 17 can be a permanent magnet or an electromagnet.

The pusher 18 can be reciprocated by a fluid-operated motor (e.g., a hydraulic or pneumatic cylinder and piston assembly) or by any other suitable prime mover so as to cause successive binders 1 to slide off the conveyor 8 and along the guide rail or guide rails 16 (i.e., along the path 14 defined by the guide means 12) toward and into the range of the magnet 17. The latter then cooperates with the pusher 18 to change the orientation of the advancing binder 1 by applying to the binder a tilting moment or torque about the longitudinal axis of the respective binder (i.e., at right angles to the plane of FIG. 3). To this end, the magnet 17 brakes the adjacent first portion of the oncoming binder 1 whereas the pusher 18 continues to advance a second portion of the same binder so that the orientation of the binder changes from that shown (at the station 7) in FIG. 2, through that shown at $W_1$ in FIG. 3, and thereupon to that shown at $W_2$, again in FIG. 3.

The novel apparatus further comprises a conveyor 21 (e.g., a plunger) which is movable up and down as indicated by a double-headed arrow 23, i.e., transversely of the path 14, to remove reoriented binders 1 from the second station 13. The conveyor 21 is provided with one or more guide rails or ribs 22 in exact alignment with the guide rail(s) 16 of the guide means 12 when the conveyor 21 is maintained in the lower end position shown in FIGS. 2, 3 and 4.

Figure 3:
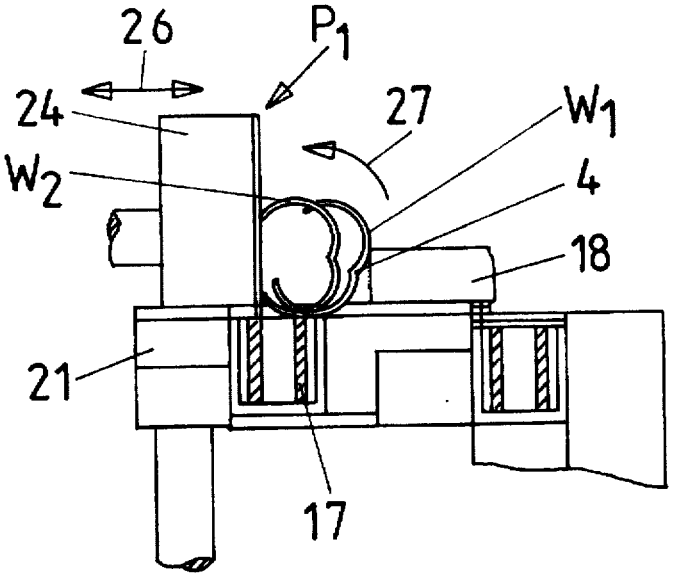
FIG. 3 illustrates the structure of FIG. 2 but with the abutment in its first position and the binder-advancing pusher in an intermediate position, a binder being shown in a partly reoriented position as well as in the fully reoriented position.
Figure 4:
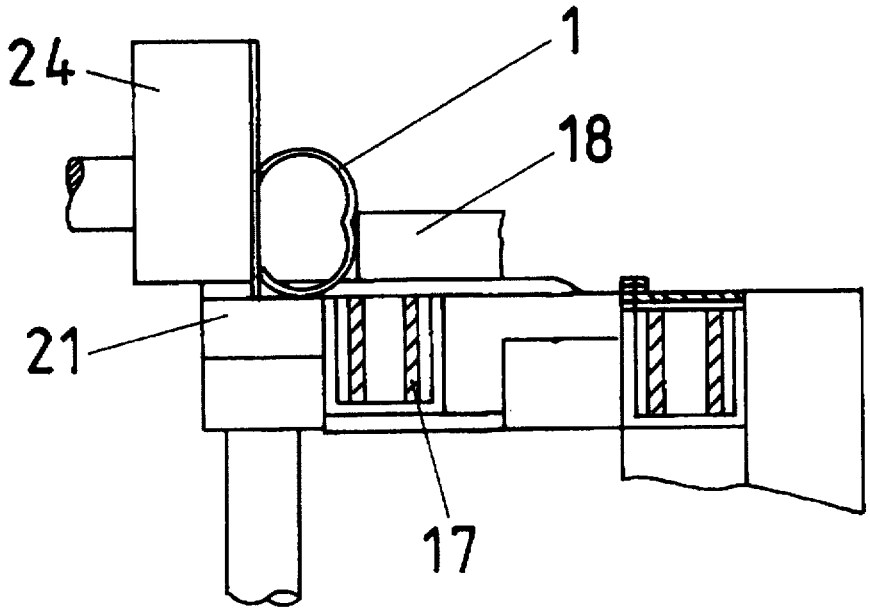
FIG. 4 shows a fully reoriented binder during the last stage of its advancement to the second station, the binder being located between the pusher and the abutment which latter is being moved in synchronism with the pusher in a direction from the first to the second position.

The reference character 24 denotes a mobile abutment which is located at the second station 13 and is movable in directions indicated by a double-headed arrow 26, namely toward and away from the first station 7. A first or rightmost position of the abutment 24 is shown in FIG. 3, as at $P_1$, an intermediate position of the abutment is shown in FIG. 4, and a second or leftmost position of the abutment is shown (at $P_2$) in FIGS. 2 and 5. The abutment 24 can be moved by a piston rod (shown but not referenced in FIGS. 2–5) which synchronizes the movements of the abutment with those of the pusher 18, at least during movement of the abutment 24 from the position $P_1$ to the position P2. The arrow 27 (shown in FIG. 3) indicates the direction in which the orientation of a binder 1 is changed during that stage of its movement from the station 7 toward the station 13 when the binder is being braked by the magnet or magnets 17.

When it assumes the first position $P_1$, the abutment 24 terminates the tilting (i.e., the change of orientation) of a binder 1 which is being advanced by the pusher 18 and is simultaneously braked by the magnet or magnets 17. When it reaches the second position $P_2$, the abutment 24 terminates the advancement of a binder 1 under the action of the pusher 18. The conveyor 21 is free to move upwardly after the abutment 24 returns to the second position $P_2$.

The operation is as follows:

It is assumed that the conveyor 8 serves to deliver discrete binders 1 of finite length to the first station 7 by moving such binders lengthwise, i.e., at right angles to the plane of FIG. 2. Alternatively, and as already mentioned hereinbefore, the apparatus can include or can cooperate with a knife or another suitable severing device which separates from the leading end of an intermittently advancing continuous binder a series of successive discrete binders 1 of desired length. The pusher 18 is maintained in the retracted position of FIG. 2 during advancement of a discrete binder 1 or the leading end of a continuous binder into the first station 7. It is assumed that a binder is caused to enter the station 7 in such a way that its row of webs 3 is adjacent the front end face of the retracted pusher 18. As shown in FIG. 2, the abutment 24 is then maintained in the second position $P_2$, i.e., outside of and adjacent the second station 13. The conveyor 21 is maintained in its lower end position in which its rail or rails 22 are flush with the neighboring guide rail or rails 16 of the guide means 12.

The next step involves the forward movement of the pusher 18 in order advance the binder 1 toward the second station 13. The binder 1 slides along the guide rail(s) 16, e.g., with a minimum of friction, until it reaches the magnetic field which is established by the magnet or magnets 17 (hereinafter referred to as a single magnet). The guide rail or rails 16 ensure that the advancing binder 1 remains in its path 14 and that its longitudinal axis remains normal to the plane of FIG. 3 which shows the pusher 18 in an intermediate position and the abutment 24 in the right-hand end position $P_1$. The movement of the abutment 24 from the position $P_2$ of FIG. 2 to the position $P_1$ of FIG. 3 can take place simultaneously with the movement of the pusher 18 from the position of FIG. 2 toward the second station 13.

The magnet 17 brakes (e.g., actually arrests) the adjacent portion (the prongs 2) of the oncoming binder 1. Such braking action can begin (see FIG. 3) before the prongs 2 of the binder 1 in the path 14 actually reach the abutment 24. The pusher 18 continues to advance a second portion of the binder 1 in the range of the magnet 17 toward the abutment 24, i.e. the pusher 18 cooperates with the magnet 17 to tilt the binder 1 about the latter's longitudinal axis so that the binder first reaches the intermediate position $W_1$ of partial reorientation and thereupon the position $W_2$ of full reorientation through an angle of close to or exactly 90°. The abutment 24 arrests the binder 1 in the fully reoriented position in which the prongs 2 as well as the webs 3 of such binder abut the adjacent side of the abutment. The pusher 18 then engages the reoriented binder 1 along the row of spines 4. Thus, tilting of the binder 1 in the path 14 involves a counterclockwise turning so that the binder rolls along the guide means 12 and/or along the upper side of the retracted conveyor 21 in the region of its prongs 2 and the open side of the binder no longer faces upwardly (see FIG. 2) but rather toward the abutment 24. As shown in FIG. 3 (note the position $W_2$), the sliding and tilting or turning movements of the binder 1 are terminated when its prongs 2 as well as its webs 3 abut the adjacent side of the reciprocable member 24.

Figure 5:
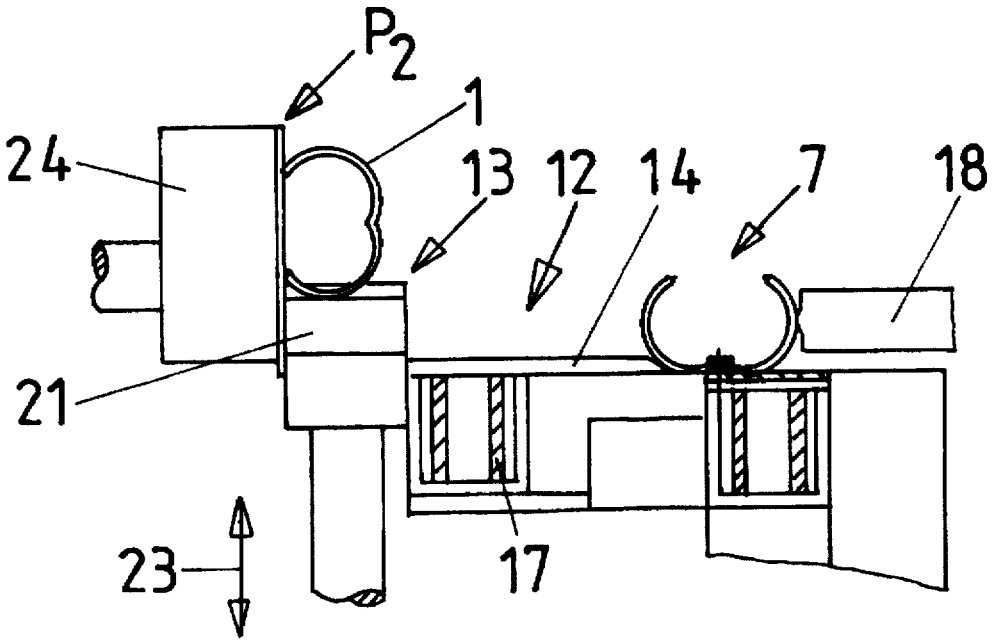
FIG. 5 illustrates the structure of FIGS. 2, 3 or 4 but with a fully reoriented binder in the process of being removed from the second station and a further binder located at the first station.

The next step involves a joint (synchronous) movement of the pusher 18 and abutment 24 from the positions which are shown in FIG. 3, through the positions shown in FIG. 4 and to their left-hand end positions. The left-hand end position ($P_2$) of the abutment 24 is shown in FIG. 5 but the pusher 18 is shown in a position it assumes subsequent to retraction back to the starting position of FIG. 2 in which it permits a fresh binder 1 or the leader of a continuous binder to enter the first station 7. FIG. 5 further shows the conveyor 21 in the process of lifting the freshly reoriented binder 1 above and away from the second station 13; such movement normally takes place along the adjacent side of the abutment 24 so that the binder is properly guided on its way to the inserting station, not shown. For example, the conveyor 21 can lift successive re-oriented binders 1 into the range of suitable tongs serving to insert the prongs 2 of such binders into the holes of stacked sheets which are to be converted into pads or the like. Alternatively, and as already described with reference to British patent No. 987 117 and published UK patent application No. 2 257 070 A, the conveyor 21 can serve to advance reoriented binders 1 onto or toward a holder which is used to accumulate mats or other suitable arrays of binders which can be put to storage or transported as a group to an inserting station.

If the binders 1 do not contain a magnetizable material, the magnet 17 can be replaced by another suitable braking device, for example, by roughened portions of the rails 22 and/or 16. This ensures that the braking device including such roughened portions can cooperate with the pusher 18 to change the orientation of successive binders 1 not later than at the time of arrival at the second station 13 (somewhat to the left of the position of the binder 1 which is shown in FIG. 4). Of course, it is equally possible to roughen the magnet 17 in such a way that it can magnetically brake successive binders 1 which contain a magnetizable material or successive diamagnetic binders.

An important advantage of the improved method and apparatus is that, at least for all practical purposes, the means for changing the orientation of successive binders 1 does not or need not take up any additional space. All that is necessary is to properly position one or more magnets 17 or analogous braking means next to the path 14 for the advancement of successive binders 1 from the station 7 to the station 13, i.e., to install such braking means into or next to the guide means 12. The orientation of the binders 1 can be changed without moving the binders along arcuate paths but rather by the simple expedient of turning the binders about their respective longitudinal axes during advancement between the stations 7 and 13.

Another important advantage of the improved method and apparatus is that the reorientation of successive binders 1 can be carried out in part by resorting to a component which also performs another important function, namely to the pusher 18 which serves as a means for advancing or moving successive binders from the station 7 to the station 13, and in part by a simple stationary component, such as the magnet 17 or a set of two or more stationary magnets.

The path 14 can be a relatively short straight path; this contributes to simplicity as well as to compactness and reliability of the improved apparatus.

The mobile abutment 24 constitutes an optional but highly desirable and advantageous feature of the improved apparatus; it not only ensures that the tilting of successive binders 1 is terminated when the binders reach their desired optimum reoriented positions but the abutment also limits the extent of movability of successive binders toward the second station 13. Still further, the abutment 24 serves as a reliable guide for the transport of successive freshly reoriented binders 1 under the action of the conveyor 21, i.e., away from the second station 13, so that the reoriented binders cannot change or are highly unlikely to change their orientation during transport away from the station 13.

A further important advantage of the improved apparatus is its versatility. Thus, the apparatus can be readily converted from an assembly of parts for manipulating binders which contain a magnetizable material into an assembly of parts for manipulating binders which cannot be influenced by magnetic force. In fact, and as already described hereinbefore, the magnet 17 can be designed in such a way that it attracts and frictionally engages selected portions of successive binders which contain a magnetizable material, or that it merely frictionally engages selected portions of successive binders which cannot be properly manipulated solely under the action of magnetic force.

An additional important advantage of the improved apparatus is that it can be readily installed in existing production lines or machines for the making of stationery products of the type wherein piles or stacks of sheets are pivotably held together by one or more converted wire comb binders, i.e., wire comb binders which are delivered to the inserting station in an open form (having a substantially C-shaped cross-sectional outline as shown in each of FIGS. 1 to 5), and are thereupon deformed to introduce their prongs 2 into the selected perforations of stacked sheets or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating wire binders and, therefore, such adaptations should and are intended to be comprehended within the meaning and range of equivalence of the appended claims.

What is claimed is:

1. Apparatus for transferring successive elongated wire comb binders for accumulations of perforated sheets from a first station, at which the binders are maintained in a first orientation, to a second station, comprising guide means defining a path extending from said first station to said second station; means for advancing successive binders along said path from said first station to said second station, including means for moving the binders sideways; and means for changing the orientation of binders during advancement along said path.

2. The apparatus of claim 1, wherein said guide means includes means for confining successive binders to a sliding movement of from said first station toward said second station, said advancing means including means for pushing successive binders along said path.

3. The apparatus of claim 2, wherein said means for confining comprises at least one guide rail extending along at least a portion of said path from said first station toward said second station.

4. The apparatus of claim 1 for transferring successive elongated binders having longitudinal axes, wherein said means for changing the orientation of successive binders further includes means for turning the binders about the respective longitudinal axes.

5. The apparatus of claim 1, further comprising at least one mobile abutment for successive binders being advanced toward said second station.

6. Apparatus for transferring successive elongated wire comb binders for accumulations of perforated sheets from a first station, at which the binders are maintained in a first orientation, to a second station, said binders having longitudinal axes, comprising guide means defining a path extending from said first station to said second station; means for advancing successive binders along said path from said first station to said second station, comprising means for moving the elongated binders at least substantially transversely of their respective longitudinal axes; and means for changing the orientation of successive binders during advancement along said path, including means for turning the binders about their respective longitudinal axes.

7. The apparatus of claim 6, wherein said turning means cooperates with said moving means to exert a tilting torque upon a binder being advanced along said path.

8. The apparatus of claim 6, wherein said means for turning the binders is adjacent a portion of said path and includes means for braking a first portion of a binder advancing along said path while said moving means advances a second portion of the binder being braked by said braking means so that the second portion moves relative to the first portion about the respective axis.

9. The apparatus of claim 8 for transporting binders containing a magnetizable material, wherein said braking means includes at least one magnet.

10. The apparatus of claim 9, wherein said at least one magnet is disposed at a level beneath said portion of said path.

11. The apparatus of claim 8, wherein said braking means includes means for frictionally engaging the first portion of a binder advancing along said path.

12. The apparatus of claim 11, wherein said means for frictionally engaging defines said portion of said path.

13. The apparatus of claim 11, wherein said means for frictionally engaging forms part of said guide means.

14. Apparatus for transferring successive wire comb binders for accumulations of perforated sheets from a first station, at which the binders are maintained in a first orientation, to a second station, comprising guide means defining a path extending from said first station to said second station; means for advancing successive binders along said path from said first station to said second station; at least one mobile abutment for successive binders being advanced toward said second station; and means for changing the orientation of binders during advancement along said path.

15. The apparatus of claim 14, wherein said at least one abutment is positioned to limit the extent of changes of orientation of binders being advanced along said path.

16. The apparatus of claim 14, further comprising means for moving said at least one abutment along a portion of said path toward and away from said first station.

17. The apparatus of claim 14, wherein said advancing means comprises means for moving the binders sideways.

18. The apparatus of claim 14, further comprising means for moving said at least one abutment along a portion of said path between a first position nearer to said first station in which the at least one abutment terminates the change of orientation of the binder being advanced along said path, and a second position more distant from said first station in which the at least one abutment terminates the advancement of a binder along said path.

19. The apparatus of claim 18, further comprising means for moving said at least one abutment at least substantially in synchronism with said advancing means at least during movement of said at least one abutment from said first toward said second position thereof.

20. The apparatus of claim 18, further comprising means for removing reoriented binders from said second station in the second position of said at least one abutment.

21. The apparatus of claim 20, wherein said removing means comprises a conveyor which is movable substantially transversely of said path.

* * * * *